United States Patent [19]

Simmons, Sr.

[11] 3,949,587

[45] Apr. 13, 1976

[54] FRONT AND REAR MAGNETIC GAUGES FOR A PRESS BRAKE AND THE METHOD OF OPERATING SAME

[76] Inventor: Roscoe H. Simmons, Sr., 1817 Larnard Drive, Des Moines, Iowa 50317

[22] Filed: Sept. 23, 1974

[21] Appl. No.: 508,615

[52] U.S. Cl. ..... 72/379; 72/389; 72/461; 269/8

[51] Int. Cl.[2] ..... B21D 11/22

[58] Field of Search ..... 72/461, 36, 389, 379; 83/451, 467; 269/319, 303, 8

[56] References Cited

UNITED STATES PATENTS

| | | | |
|---|---|---|---|
| 2,627,890 | 2/1953 | Lloyd | 72/461 |
| 3,225,584 | 12/1965 | Begg | 72/461 |
| 3,668,919 | 6/1972 | Hongo | 72/453 |
| 3,733,885 | 5/1973 | Brauer | 72/461 |
| 3,826,119 | 7/1974 | Marotto | 72/461 |

FOREIGN PATENTS OR APPLICATIONS

| | | | |
|---|---|---|---|
| 1,486,684 | 8/1920 | United Kingdom | 83/467 |

*Primary Examiner*—C. W. Lanham
*Assistant Examiner*—Gene P. Crosby
*Attorney, Agent, or Firm*—Zarley, McKee, Thomte, & Voorhees

[57] ABSTRACT

A press brake includes gauges on opposite sides of the punch for positioning a sheet of material being worked upon. Each of the gauges includes a magnet in the end abutting the work piece. The magnet on the back side of the punch is carried on a rod adjustably positioned by a U-bolt. The end of the rod abutting the work piece and including the magnet is convex in shape to maintain tangential contact with the work piece and thereby allow slight misalignment. The gauge on the front side of the punch is made from sheet material and has a tapered front end which includes a transversely extending surface including the magnet. The method of forming the work piece into a finished item includes positioning the front gauge a distance away from the centerline of the die and punch equal to the length of the finished work piece. One end of the work piece is positioned against the back gauge and the punch is operated. The work piece is then rotated 180° with the shaped end bearing against the front gauge followed by operation of the punch thereby producing a finished work piece having a length equal to the distance between the front gauge and the centerline of the press. An alternate gauge or stop is provided for the back side of the press and includes a slotted gauge member having an upstanding cylindrical magnetized pin for engagement by the work piece.

9 Claims, 8 Drawing Figures

FRONT AND REAR MAGNETIC GAUGES FOR A PRESS BRAKE AND THE METHOD OF OPERATING SAME

In the operaton of a press brake it is desirable to obtain maximum accuracy and efficiency with personnel having a minimum degree of skill. The gauges and method of this invention make accomplishment of this objective possible.

The press brake is provided with adjustable gauges on both sides. The back side gauge is adjustable vertically and horizontally and is held on a support including a U-shaped bolt embracing the rod-shaped gauge having a convex abutting inner end for engagement with the work piece and included in the inner end is a magnet. Positioning the work piece against the inner end of the back gauge can be accomplished quickly and accurately even though the gauge itself it not in perfect perpendicular relationship to the work piece due to the rounded convex surface which provides tangential contact with the work piece. The front gauges are flat to allow the work piece to be laid over the top thereof at times when the back gauges are being used. Adjustment of the front gauges is accomplished through operation of two bolts extending through elongated slots in the plate-type gauge having a tapered forward end with a magnet in the transversely extending forward end surface.

The method of fabricating the finished product from a sheet of metal includes first positioning the front gauge away from the centerline of the punch and bed a distance equal to the length of the finished piece that is desired. The first bending operation is formed by placing the work piece against the back gauges and then operating the punch. Next the work piece is turned around 180° such that the shape end is now against the front gauges and the other end is under the punch. The ram is operated to shape the other end of the work piece thereby producing the finished product which has a length equal to that desired and equal to the distance between the front gauges and the centerline of the press. At a separate work station on the press brake an alternate pair of gauges is provided which accommodates vertical flexing of a sheet of material being worked upon. The gauge includes an elongated slotted base member having an upstanding magnetized cylindrical pin against which the work material abuts. This is particularly suited for long pieces of material having ends spaced a substantial distance from the die and punch.

The invention consists in the construction, arrangements and combination of the various parts of the device, whereby the objects contemplated are attained as hereinafter more fully set forth, specifically pointed out in the claims, and illustrated in the accompanying drawings in which:

Figure 1:
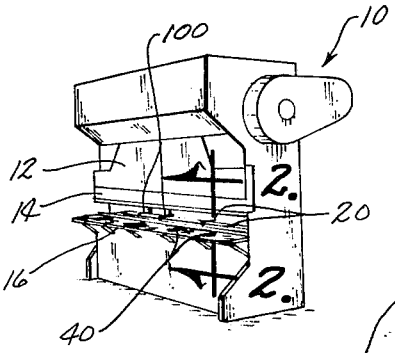
FIG. 1 is a reduced in scale perspective view of a press brake including the gauges of this invention.

The press brake of this invention is referred to generally in FIG. 1 by the reference numeral 10 and includes a ram 12 having a punch 14 over a front bed 16. At the inner or front end of the bed 16 is a die 18.

Figure 2:
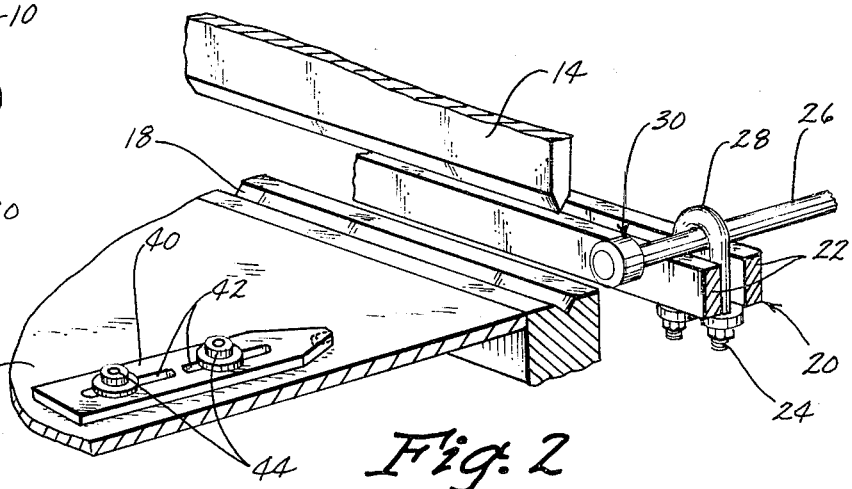
FIG. 2 is a fragmentary enlarged perspective view of the front and rear gauges on the press taken along line 2 — 2 of FIG. 1.
Figure 7:
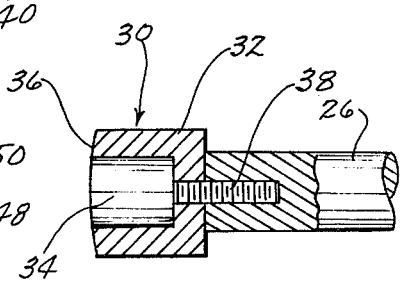
FIG. 7 is a cross sectional view taken along line 7 — 7 in FIG. 3 showing in detail the rear gauge.

As seen in FIG. 2, rear gauges 20 are provided which include spaced apart support plates 22 between which a U-bolt 24 extends. A cylindrical rod 26 is clamped against the top edges of the plates 22 by the bight section 28 of the U-bolt 24 to adjustable position the rod 26 relative to the punch 14. The inner end 30 of the rod 26 includes a head 32 having an embedded permanent magnet 34. The magnet and the head cooperate to provide a convex surface 36 as seen in FIG. 7. The head 32 is attached to the rod 26 by a threaded pin 38.

The front of the press is provided with front gauges 40 which are formed from elongated plates having elongated slots 42 through which bolts 44 extend and bolt onto the bed 16. The forward ends of the plates are tapered to provide converging tapering surfaces 46 which terminate in a transversely extending abutting surface 48 having a magnet 50 therein.

Figure 3:
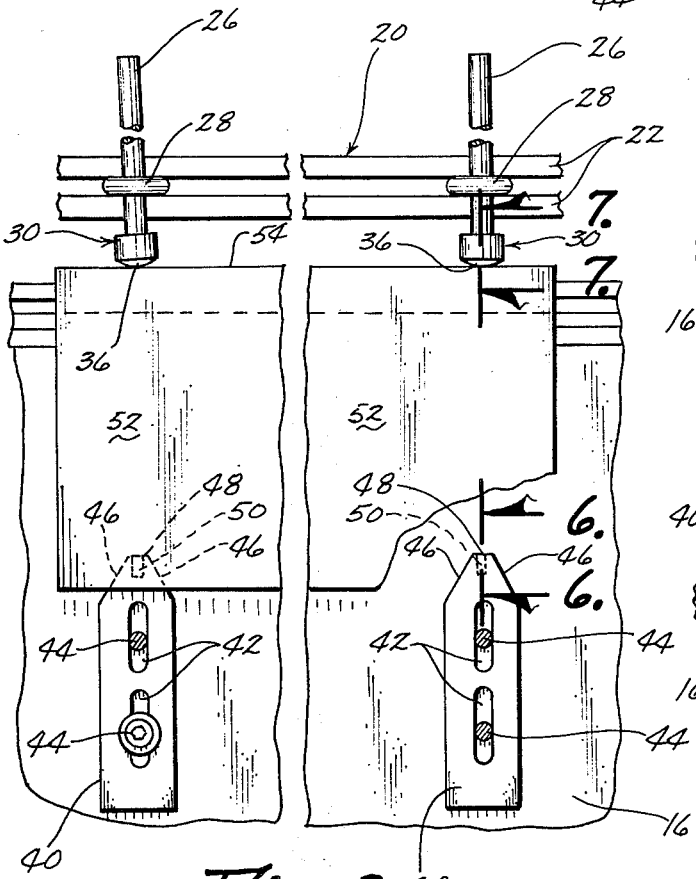
FIG. 3 is a fragmentary top plan view of a work piece in the press with the work piece engaging the rear gauges and one of the rear gauges being shown slightly out of alignment but still performing its desired function due to the convex abutting inner end contacting the edge of the work piece.
Figure 4:
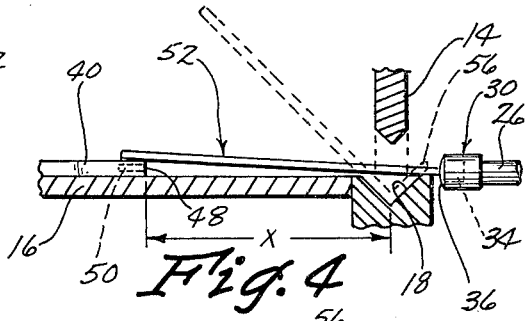
FIG. 4 is a reduced in sacle cross sectional view showing a work piece in the press with one end abutting against the rear gauges. The dash lines indicate the work piece after the press has been operated.
Figure 5:
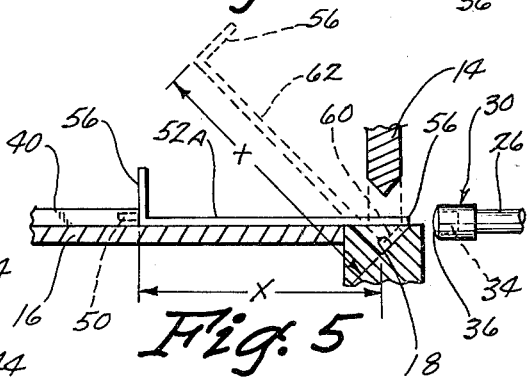
FIG. 5 is a view similar to FIG. 4 but showing the work piece rotated 180° before and after the second press operation.
Figure 6:
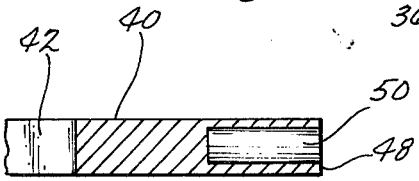
FIG. 6 is a cross sectional view taken along line 6 — 6 in FIG. 3 showing in detail the magnet in the front gauge.

Thus in operation a flat sheet-like work piece 52 is provided to be worked upon by the press brake 10. The first step is to position the front gauges 40 at a distance $x$ as seen in FIG. 4 away from the centerline of the press with this distance equaling the length of the desired finished work piece as seen in FIG. 5. Next, as seen in FIGS. 3 and 4, one end 54 of the work piece 52 is placed in the press against the convex surfaces 36 of the gauge 20. It is noted, as seen in FIG. 3, that even if the rod 26 is not perpendicular to the work piece 52 the convex surface providing tangential contact with the work piece inner end 54 will still provide accurate gauging. Next, the punch 14 is operated to produce the work piece 52A as indicated by the dash lines in FIG. 4 wherein a portion 56 is provided extending at a 90° angle to the remaining sheet material. A work piece 52A is now turned 180°, as seen in FIG. 5, with the portion 56 abutting against the gauges 40 on the front side of the press and now the opposite end of the work piece is under the punch 14. The punch 14 is lowered to form a second portion 60 thereby defining between the portions 56 and 60 a main sheet of material 62 having a length equal to $x$ which in turn is equal to the distance between the centerline of the press and the inner surfaces of the front gauges 40.

It is appreciated that the magnets in each of the gauges 20 and 40 facilitate making quick contact with the work piece and maintaining this contact during the press operations. Also the flat front gauges 40 are such as seen in FIG. 4 that work piece may be laid over the top thereof without interferring with the operation of the press or the accuracy of the bending operation.

Furthermore, the front gauges 40 are out near the operator and can be easily manipulated.

It is further seen that exact measurements on the finished piece of material 62 result due to the method described and cumulative errors are avoided. The critical dimension in the finished product is the length of the portion 62 rather than the length of the portions 56 and 60.

Figure 8:
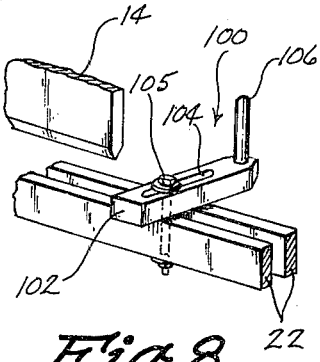
FIG. 8 is a perspective view of an alternate back gauge including a vertically disposed magnetized pin.

In situations where long sheets of material are being worked upon the ends tend to flex up and down requiring a vertically disposed gauge. Accordingly, in FIG. 8, an alternate gauge 100 is shown which includes an aluminum elongated base 102 having an elongated slot 104 through which a bolt 105 extends between the support plates 22. An upstanding magnetized cylindrical pin 106 is provided on the rear end. It is thus seen that the work piece when placed on the bed of the press 10 will have its rear end engaging the magnet elements 106. These elements are tall enough to accommodate any flexing of the work piece. The gauges 100 are spaced a greater distance from the ram and punch than are the gauges 20 as seen in FIG. 1. The vertical lateral movement is not a problem when the ends of the work pieces are positioned close to the press as seen in FIGS. 4 and 5.

I claim:

1. The method of shaping a flat sheet metal work piece on a brake press wherein the brake press includes gauges on either side of said punch and said gauge includes magnets in their inner opposing ends so that an operator being positioned on one side only can work without placing his hands between said punch and gauge as the work piece is held by said gauges, including the steps of, positioning a front gauge at a distance from the centerline of said punch corresponding to the length of the desired completed work piece, positioning one end of the work piece under said punch and against and held by a back gauge with the other end of the work piece extending over the front gauge, operating said punch to make a fold in said work piece, turning the work piece 180° and positioning the outer surface of said fold against said front gauge with the other end of said work piece under said punch, and operating the punch to make a second fold in said work piece with the distance between folds being equal to the length of the desired completed work piece.

2. A press brake having adjustable front and rear magnetic gauges, comprising, a press brake having front and rear sides, a die and a punch, a first gauge having a magnet in one end facing said punch and positioned on the back side of said press brake, said gauge including a support having a vertically disposed U-bolt and an elongated rod extending through said U-bolt for adjustably positioning said first gauge relative to said punch, and a second gauge having a magnet in one end facing said punch and positioned on the front side of said press brake.

3. The structure of claim 2 wherein said one end of said first gauge is further defined as being convex towards said punch to present a rounded surface for abutment against a work piece.

4. The structure of claim 3 wherein said first gauge is one of a plurality of gauges on the back side of said brake press.

5. A press brake having adjustable front and rear magnetic gauges, comprising, a press brake having front and rear sides, a die and a punch, a gauge having a magnet in one end facing said punch and positioned on the back side of said press brake, said gauge including an adjustable base having an upstanding magnetized pin against which a work piece may abut, said pin having a height sufficient to allow for vertical flexing of the work piece and abutting against the pin, and a second gauge having a magnet in one end facing said punch and positioned on the front side of said press brake.

6. The structure of claim 5 wherein the base includes an elongated slot which receives a fastening bolt carried on a support whereby said gauge may be adjusted by moving it relative to said bolt.

7. A press brake having adjustable magnetic gauges, comprising, a press brake having front and rear sides, a die and a punch, and a plurality of gauges arranged to retain and hold a work piece in a desired position, each gauge having a magnet in one end facing said punch and positioned on one side of said press brake, and said gauge including an adjustable base having an upstanding magnetized pin against which a work piece may abut, said pin having a height sufficient to allow for vertical flexing of the work piece and abutting against the pin.

8. A press brake having adjustable magnetic gauges, comprising, a press brake having front and rear sides, a die, a punch, and a bed having a plurality of gauges on said bed arranged to retain and hold a work piece in a desired position, each gauge having a manget in one end facing said punch and positioned on one side of said press brake, said gauge being an elongated plate having tapered sides at its forward end terminating in a laterally extending abutment surface including said magnet, said abutment surface being convex towards said punch to present a rounded surface for holding abutment against a sheet metal work piece, and means adjustably securing said gauge to said bed.

9. The structure of claim 8 wherein said plate includes a pair of longitudinally spaced apart slots and bolts are carried on said bed and extend through said slots to adjustably position said plate relative to said punch.

* * * * *